US010385651B2

(12) United States Patent
Smith et al.

(10) Patent No.: US 10,385,651 B2
(45) Date of Patent: Aug. 20, 2019

(54) FRAC PLUG WITH RETENTION MECHANISIM

(71) Applicant: PetroQuip Energy Services, LLP, Waller, TX (US)

(72) Inventors: Roddie R. Smith, Katy, TX (US); Robert Joe Coon, Missouri City, TX (US)

(73) Assignee: PETROQUIP ENERGY SERVICES, LLP, Waller, TX (US)

( * ) Notice: Subject to any disclaimer, the term of this patent is extended or adjusted under 35 U.S.C. 154(b) by 0 days.

(21) Appl. No.: 15/591,383

(22) Filed: May 10, 2017

(65) Prior Publication Data

US 2018/0328136 A1 Nov. 15, 2018

Related U.S. Application Data

(60) Provisional application No. 62/466,482, filed on Mar. 3, 2017, provisional application No. 62/382,464, filed
(Continued)

(51) Int. Cl.
*E21B 33/129* (2006.01)
*E21B 33/128* (2006.01)
(Continued)

(52) U.S. Cl.
CPC ..... *E21B 33/1292* (2013.01); *E21B 23/01* (2013.01); *E21B 33/12* (2013.01);
(Continued)

(58) Field of Classification Search
CPC .... E21B 33/12; E21B 33/1216; E21B 33/128; E21B 33/129; E21B 33/1292
See application file for complete search history.

(56) References Cited

U.S. PATENT DOCUMENTS 4,934,452 A 6/1990 Bradley
6,224,112 B1 5/2001 Eriksen et al.
(Continued)

FOREIGN PATENT DOCUMENTS

WO 2012-045168 A1 4/2012
WO 2016-065291 A1 4/2016

OTHER PUBLICATIONS

PCT/US2017/036692—International Search Report and Written Opinion of he International Searching Authority, dated Jun. 9, 2017, 17 pages.
(Continued)

*Primary Examiner* — David J Bagnell
*Assistant Examiner* — Tara E Schimpf
(74) *Attorney, Agent, or Firm* — Nolte Intellectual Property Law Group

(57) ABSTRACT

A frac plug is provided. The frac plug may include a first sub, a second sub, a slip, a sealing element, a lock ring, a back-up ring, and a compression ring. The first sub may be threadably engaged with the lock ring. The lock ring may be threadably engaged with the second sub. The slip and the back-up ring may be positioned between the first sub and the second sub, and circumferentially disposed about a tapered outer surface of the first sub. The slip and the back-up ring may include a tapered inner surface. The slip may also include a left-hand thread profile defined by the outer surface. The sealing element and compression ring may be circumferentially disposed about the first sub, and the compression ring may be threadably engaged with the first sub.

18 Claims, 11 Drawing Sheets

Related U.S. Application Data on Sep. 1, 2016, provisional application No. 62/350, 231, filed on Jun. 15, 2016.

(51) Int. Cl.
*E21B 23/01* (2006.01)
*E21B 33/12* (2006.01)

(52) U.S. Cl.
CPC ..... *E21B 33/128* (2013.01); *E21B 33/129* (2013.01); *E21B 33/1216* (2013.01); *E21B 33/1293* (2013.01)

(56) References Cited

U.S. PATENT DOCUMENTS

| | | | | |
|---|---|---|---|---|
| 6,302,217 | B1 | 10/2001 | Kilgore et al. | |
| 8,336,616 | B1 | 12/2012 | McClinton | |
| 2004/0104025 | A1 | 6/2004 | Mikolajczyk | |
| 2008/0308266 | A1 | 12/2008 | Roberts et al. | |
| 2010/0051293 | A1* | 3/2010 | Ezell | E21B 23/00 166/382 |
| 2010/0132960 | A1 | 6/2010 | Shkurti et al. | |
| 2011/0115168 | A1 | 5/2011 | Miller et al. | |
| 2011/0180273 | A1* | 7/2011 | Hughes | E21B 17/04 166/380 |
| 2011/0259610 | A1* | 10/2011 | Shkurti | E21B 33/1204 166/386 |
| 2012/0152524 | A1 | 6/2012 | Myers et al. | |
| 2012/0267099 | A1* | 10/2012 | Simson | E21B 23/01 166/277 |
| 2013/0192853 | A1* | 8/2013 | Themig | E21B 33/1216 166/387 |
| 2015/0247376 | A1 | 9/2015 | Tolman et al. | |
| 2015/0308215 | A1 | 10/2015 | Kellner et al. | |
| 2015/0361756 | A1 | 12/2015 | Frazier | |
| 2016/0061001 | A1* | 3/2016 | Fitzhugh | E21B 33/1292 166/386 |
| 2016/0305215 | A1* | 10/2016 | Harris | E21B 33/1291 |
| 2018/0171746 | A1* | 6/2018 | Dudzinski | E21B 33/1285 |

OTHER PUBLICATIONS

PCT/US2017/036729—International Search Report and Written Opinion of he International Searching Authority, dated Jun. 9, 2017, 17 pages.

PCT/US2017/036736—International Search Report and Written Opinion of he International Searching Authority, dated Jun. 9, 2017, 16 pages.

PCT/US2017/036742—International Search Report and Written Opinion of he International Searching Authority, dated Jun. 9, 2017, 18 pages.

PCT/US2017/036252—International Search Report and Written Opinion of the International Searching Authority, dated Sep. 21, 2017, 20 pages.

* cited by examiner

FRAC PLUG WITH RETENTION MECHANISIM

CROSS-REFERENCE TO RELATED APPLICATIONS

This application claims priority to U.S. Provisional Patent Application having Ser. No. 62/350,231 filed on Jun. 15, 2016, U.S. Provisional Patent Application having Ser. No. 62/382,464 filed on Sep. 1, 2016, and U.S. Provisional Patent Application having Ser. No. 62/466,482 filed on Mar. 3, 2017. These priority applications are hereby incorporated by reference in their entirety into the present application.

BACKGROUND

In oil and gas production, it is sometimes beneficial to stimulate a reservoir by pumping in high pressure fluids and particulates, such as sand. In order to do this, one or more tubular sections of a tubular installed in the well may need to be isolated for a period of time and re-opened so the well can be produced. Some current methods of isolation use a frac plug and a sealing ball. A frac plug is a hollow, cylindrical plug that can be installed in the tubular section(s) selected for isolation within the well. The sealing ball then seats in the frac plug to stop fluid flow through the frac plug location and isolate the selected tubular section(s).

Currently, frac plugs are built around a central mandrel. Typically, the central mandrel is then held in place within a tubular section using upper and lower slips. However, such designs may shift within the tubular section when a sealing ball is installed. Additionally, the sealing element is positioned between the slips. This arrangement may prevent the sealing element from fully compressing if the slips become fully engaged prior to full compression of the sealing element. Further, current frac plugs may allow extrusion of the seal during stimulation of the reservoir, or move as the plug is milled or ground to allow production.

What is needed, therefore, is a frac plug that can maintain the desired position within the tubular section, ensure full compression of the sealing element, and remain in place during milling or grinding operations.

SUMMARY

Embodiments of the disclosure may provide a frac plug. The frac plug may include a first sub, a second sub, a slip, a sealing element, and a compression ring. The first sub may have a taper extending along a first portion of an outer surface thereof. The second sub may be threadably engaged with the first sub. The slip may be circumferentially disposed about the taper of the outer surface of the first sub and adjacent to the second sub. The sealing element may be circumferentially disposed about the first sub. The compression ring may be circumferentially disposed about the first sub and abut the sealing element. The compression ring may also have an inner surface that is threadably engaged with a second portion of the outer surface of the first sub.

Embodiments of the disclosure may further provide a method for setting a frac plug within a tubular section. The method may include disposing the frac plug on a running tool. The method may also include positioning the frac plug within the tubular section using the running tool. The method may further include compressing the frac plug with the running tool such that a second sub of the frac plug ratchets along a threadable engagement with a first sub to hold the frac plug in a compressed position and causing a slip to expand along a tapered portion of an outer surface of the first sub and engage with the tubular section, retaining the frac plug in position within the tubular section.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
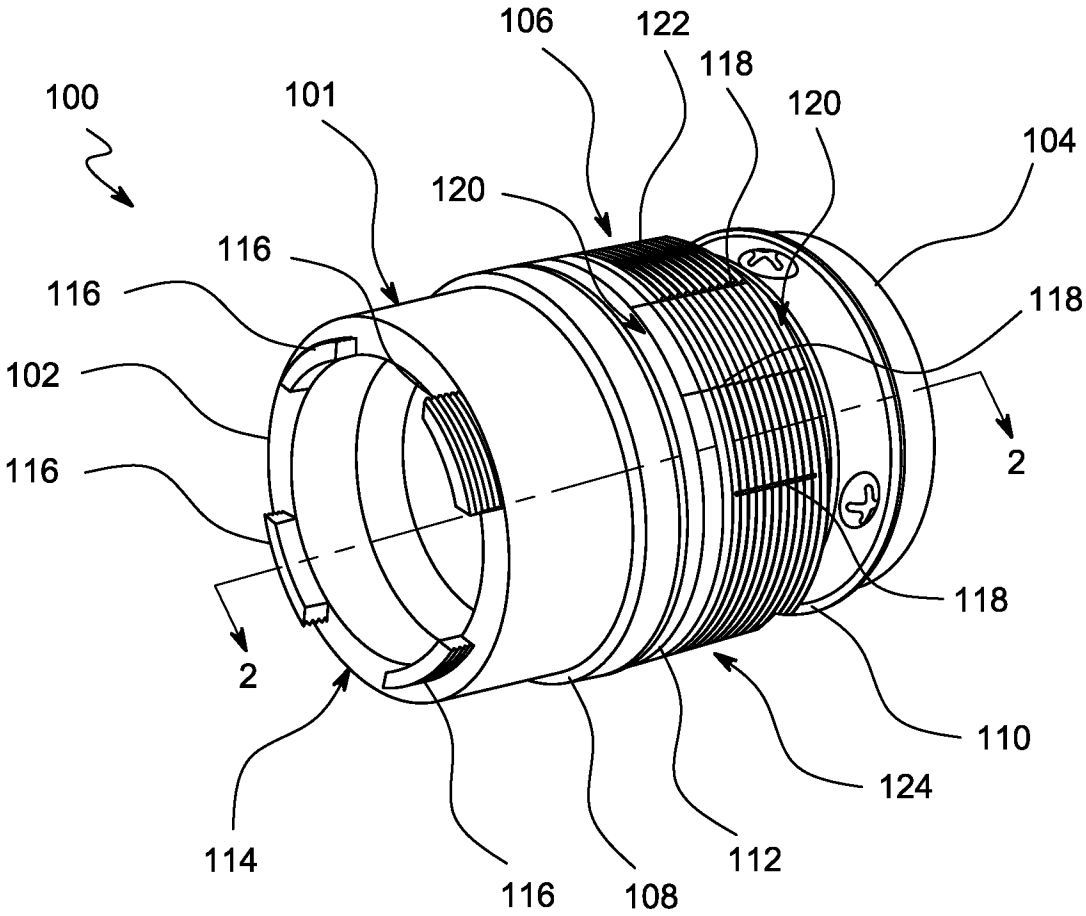
FIG. 1 illustrates an exemplary frac plug, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates an exemplary frac plug 100, according to one or more embodiments disclosed. The frac plug 100 may include a plug body 101 that includes a first sub 102 and a second sub 104. Alternative embodiments of the frac plug 100 may instead include a plug body 101 having a single sub. The frac plug 100 may further include a slip 106, a sealing element 108, a pump down ring 110, and a back-up ring 112. In at least one embodiment, the external axial ends (one shown 114) of the frac plug 100 may include circumferentially spaced, axial protrusions (four shown 116), or "castellations", extending from the frac plug 100. Other embodiments of the frac plug may have two, three, five, or more castellations 116 extending from each external axial end 114, or the castellations 116 may be omitted from one or both of the external axial ends 114 of the frac plug 100. The castellated axial ends 114 are used in stacking multiple frac plugs 100 in a manner known to the art in some embodiments.

In the exemplary embodiment, the slip 106 includes a plurality of longitudinal, only three of which are shown. The longitudinal grooves 118 extend through a portion of the axial length of the slip 106. In the exemplary embodiment, adjacent longitudinal grooves 118 extend from opposing axial ends 120 of the slip 106. In another embodiment, the longitudinal grooves may extend from only one axial end 120 of the slip 106. Other embodiments of the slip 106 may include two or more adjacent longitudinal grooves 118 that extend from the same axial end 120 of the slip 106, include longitudinal grooves 118 that extend axially through the slip 106 without interfacing with either axial end 120, or omit the longitudinal grooves 118. In the exemplary embodiment, the slip 106 also includes a left-hand thread profile 122 that is defined in an outer surface 124 of the slip 106.

Figure 2A:
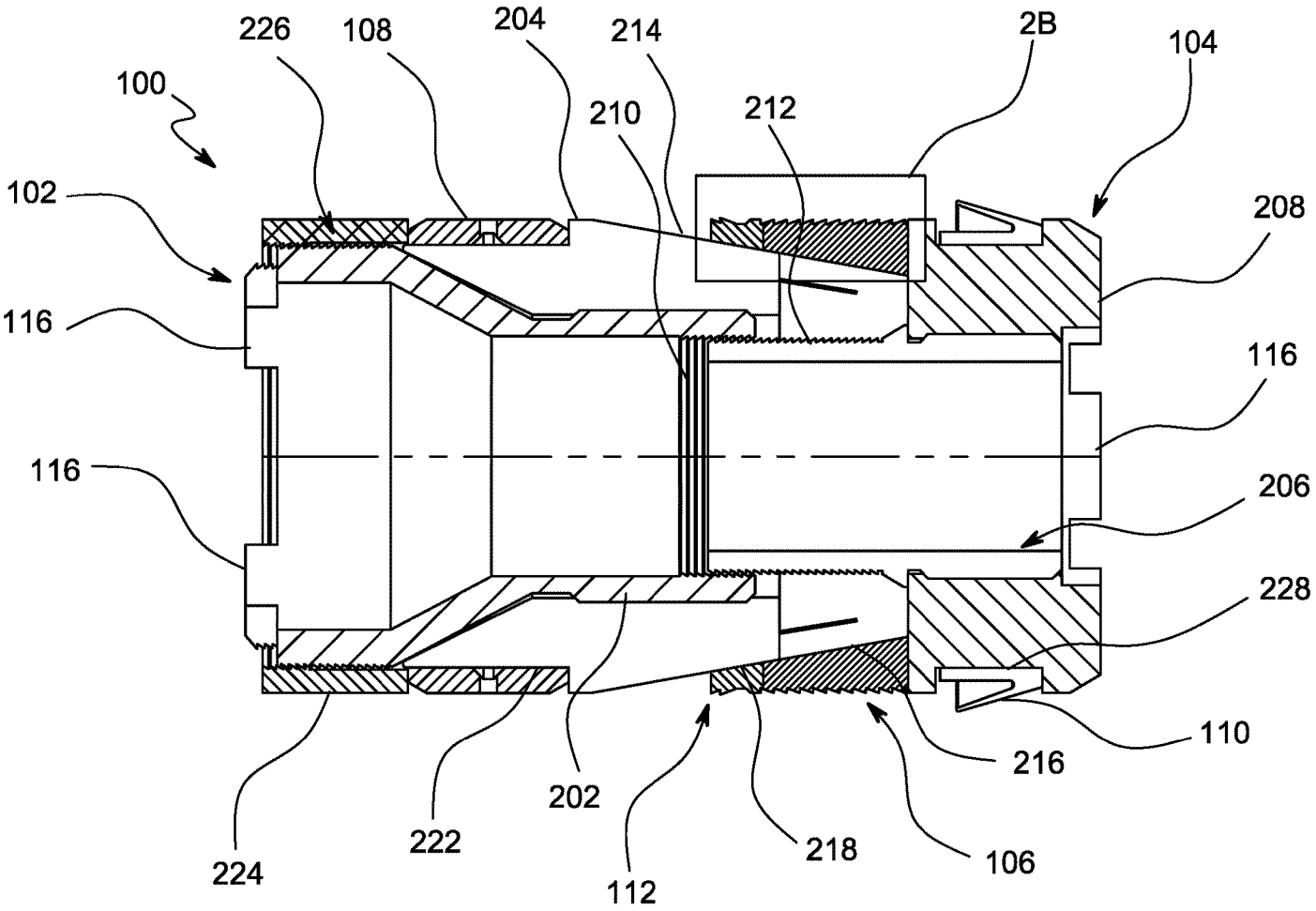
FIG. 2A illustrates a cross-sectional view of the frac plug of FIG. 1 along line 2-2.

FIG. 2A illustrates a cross-sectional view of the frac plug 100 of FIG. 1 along line 2-2. In the exemplary embodiment, the first sub 102 includes a cast or powdered metal core 202 bonded to an outer sleeve 204 formed from a resin and fiber composite material. Other embodiments of the first sub 102 may include a core 202 and outer sleeve 204 that are coupled using adhesives, a threaded connection, or both. Still other mechanisms for coupling the core 202 and sleeve 204, such as brazing, welding, and mechanical fasteners, may be used in alternative embodiments. Although the composite material in the exemplary embodiment of the outer sleeve 204 is a resin and fiber composite, other suitable composites known in the art may be used. Additionally, other embodiments of the first sub 102 may be cast or formed from powdered metal, and omit the fiber and resin composite. In another embodiment, the first sub 102 may be formed entirely from a composite material.

The second sub 104 may include a cast or powdered metal core 206 and composite outer sleeve 208, as shown in the exemplary embodiment. The core 206 may be bonded, threadably engaged, or coupled to the outer sleeve 208 using the methods described above. As with the first sub 102, the second sub 104 may be a single component that is cast, formed from powdered metal, or formed from a composite material. When assembled, the core 206 of the second sub 104 is partially disposed within the core 202 of the first sub 102. As shown FIG. 2A, the first core 202 may define an inner thread 210 that mates with an outer thread 212 of the second core 206 to couple the first sub 102 to the second sub 104.

Other embodiments of the frac plug 100 may include a first sub 102, a second sub 104, or both a first sub 102 and a second sub 104 that are predominately composite (i.e., over about 50% composite). In this context, "about" indicates that the measure need not be precisely 50%, but may be more or less depending on a number of factors. For example, variations in manufacturing processes and tools might result in embodiments whose content might deviate from the 50% mark. Similarly, some implementation specific constraints might mitigate for some deviation more or less from a precise 50% composition.

Another embodiment (not shown) of the frac plug 100 may include first and second subs 102, 104 that are completely composite. As will be appreciated by those skilled in the art, construction of completely composite first and second subs 102, 104 might possibly mitigate for a reduction of the inner bore of the frac plug 100 to prevent excessive stress in the composite material. Additional embodiments of the frac plug 100 may include first and second subs 102, 104 that are different materials, such as a cast first sub 102 and a composite second sub 104. Further embodiments (also not shown) of the frac plug 100 may include a single plug body 101 that includes a metal core (not shown) bonded, threadably engaged, or coupled to an outer sleeve (not shown) using the methods described above.

In the illustrated embodiment, the slip 106 and back-up ring 112 are positioned between the first and second subs 102, 104 of the frac plug 100, with the back-up ring 112 positioned adjacent the outer sleeve 204 and the slip 106. As shown in FIG. 2A, a portion of the outer surface 214 of the outer sleeve 204 is tapered. The slip 106, the back-up ring 112, or both may include a tapered inner surface 216, 218 that contacts the tapered outer surface 214 of the first sub 102.

In the exemplary embodiment, the slip 106 is made of a powdered metal and the back-up ring 112 is made of brass. Other embodiments of the slip 106 may be a composite material, cast iron, or any other material known in the art that is suitable for a slip. Additionally, other embodiments of the back-up ring 112 may be made of titanium or another ductile metal that will allow the back-up ring 112 to expand without fracturing.

Figure 2B:
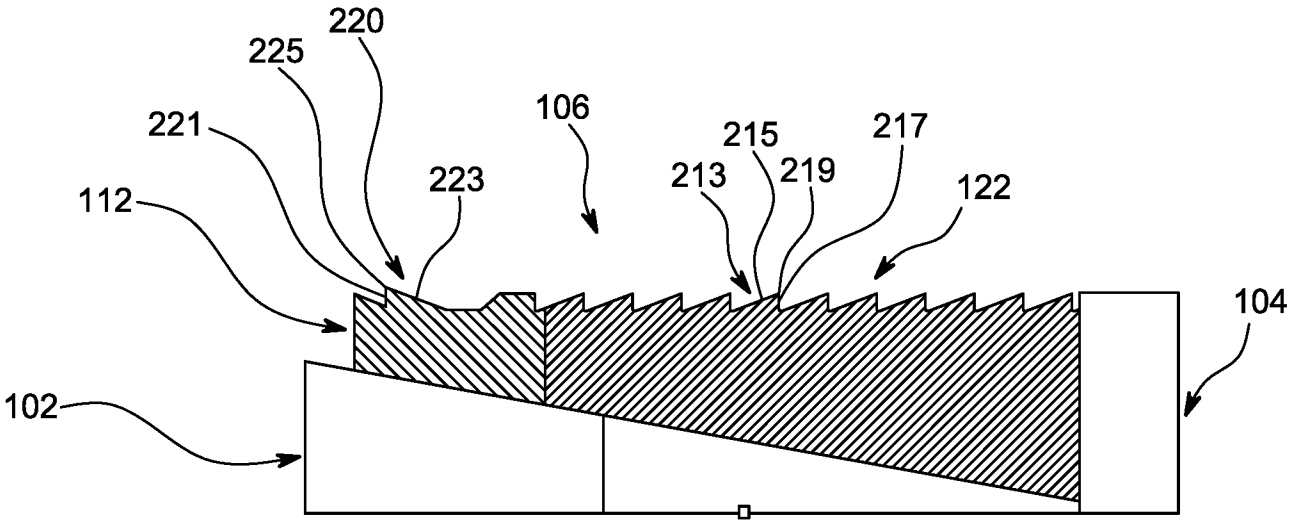
FIG. 2B illustrates an enlarged view of the portion of the frac plug indicated by the detail labeled 2B of FIG. 2A.

FIG. 2B illustrates an enlarged view of the portion of the frac plug 100 indicated by the detail labeled 2B of FIG. 2A. As shown in FIG. 2B, each thread 213 (only one indicated) of the left-hand thread profile 122 may include a first flank 215 (only one indicated) that is longer than a second flank 217 (only one indicated), angling the crest 219 (only one indicated) of each thread 213 towards the second sub 104.

Other embodiments may include threads 213 having a first flank 215 and a second flank 217 that are similar in size, and the crest 219 may be perpendicular to the slip 106.

The back-up ring 112 may include one or more threads 220 radially extending from the back-up ring 112. As shown in FIG. 2B, each thread 220 includes a first flank 221 that may be shorter than a second flank 223, angling the crest 225 of each thread 220 towards the first sub 102. In another embodiment, the threads 220 may be replaced by radial protrusions (not shown), or "teeth", having points (not shown) that angle towards the first sub 102. Other embodiments of the back-up ring 112 may include threads 220 having crests 225 or teeth having points that are generally perpendicular back-up ring 112. Further embodiments of the back-up ring 112 may omit the threads 220 and have a smooth outer surface.

Referring back to FIG. 2A, the sealing element 108 may be positioned within an annular recess 222 in the outer surface 214 of the outer sleeve 204. As shown in FIG. 2A, the sealing element 108 is independent of the slip 106. This arrangement allows the sealing element 108 and the slip 106 to be compressed independently. A compression ring 224 may be coupled to the first core 202 using a threaded connection 226, retaining the sealing element 108 in place. Additionally, the pump down ring 110 may be positioned within an annular recess 228 defined by the outer sleeve 208 of the second sub 104, as shown in FIG. 2A. Other embodiments of the frac plug 100 may omit the pump down ring 110, the annular recess 228, or both.

Figure 3A:
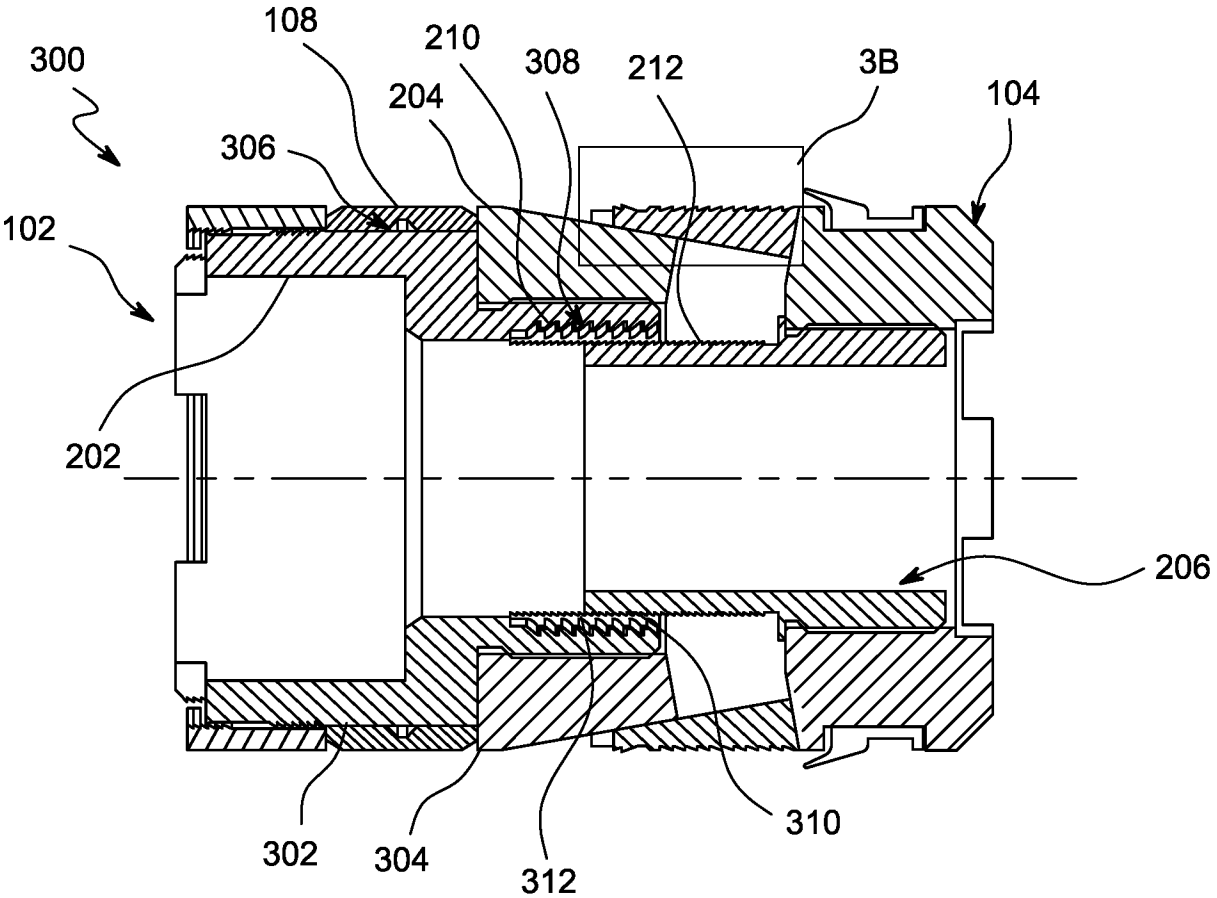
FIG. 3A illustrates a cross-sectional view of an exemplary frac plug, according to one or more embodiments disclosed.

FIG. 3A illustrates a cross-sectional view of an exemplary frac plug 300, according to one or more embodiments. The frac plug 300 illustrated in FIG. 3A is an alternative embodiment that may be used in place of the frac plug 100 illustrated in FIGS. 1 and 2A. The frac plug 300 may be substantially similar in several respects to the frac plug 100 described above with reference to FIGS. 1 and 2A. Accordingly, the frac plug 300 may be best understood with reference to the frac plug 100, where like numerals indicate like elements and therefore will not be described again in detail.

The first core 202 of the frac plug 300 may have an outer diameter 302 that is smaller than an outer diameter 304 of the outer sleeve 204, as shown in the exemplary embodiment. This may create a recessed portion 306 of the first sub 102 that allows the sealing element 108 to be circumferentially disposed about the first core 202 and adjacent the outer sleeve 204. The frac plug 300 may also include a lock ring 308 positioned between the first core 202 and the second core 206. In the exemplary embodiment, the lock ring 308 is a C-ring type lock ring that includes a gap. Other embodiments of the lock ring 308 may be continuous. The lock ring 308 may define both inner threads 310 and outer threads 312.

In the exemplary embodiment, the outer threads 312 of the lock ring 308 mate with the inner threads 210 of the first core 202, and the inner threads 310 of the lock ring 308 may mate with the outer threads 212 of the second core 206. The outer threads 312 of the lock ring 308 and the inner threads 210 of the first core 202 may have a larger pitch than the inner threads 310 of the lock ring 308 and the outer threads 212 of the second core 206, as shown in FIG. 3A. In other embodiments, the pitch of the two sets of threads 312, 210, 310, 212 may be the same size, or the outer threads 312 of the lock ring 308 and the inner threads 210 of the first core 202 may have a smaller pitch than the inner threads 310 of the lock ring 308 and the outer threads 212 of the second core 206.

Figure 3B:
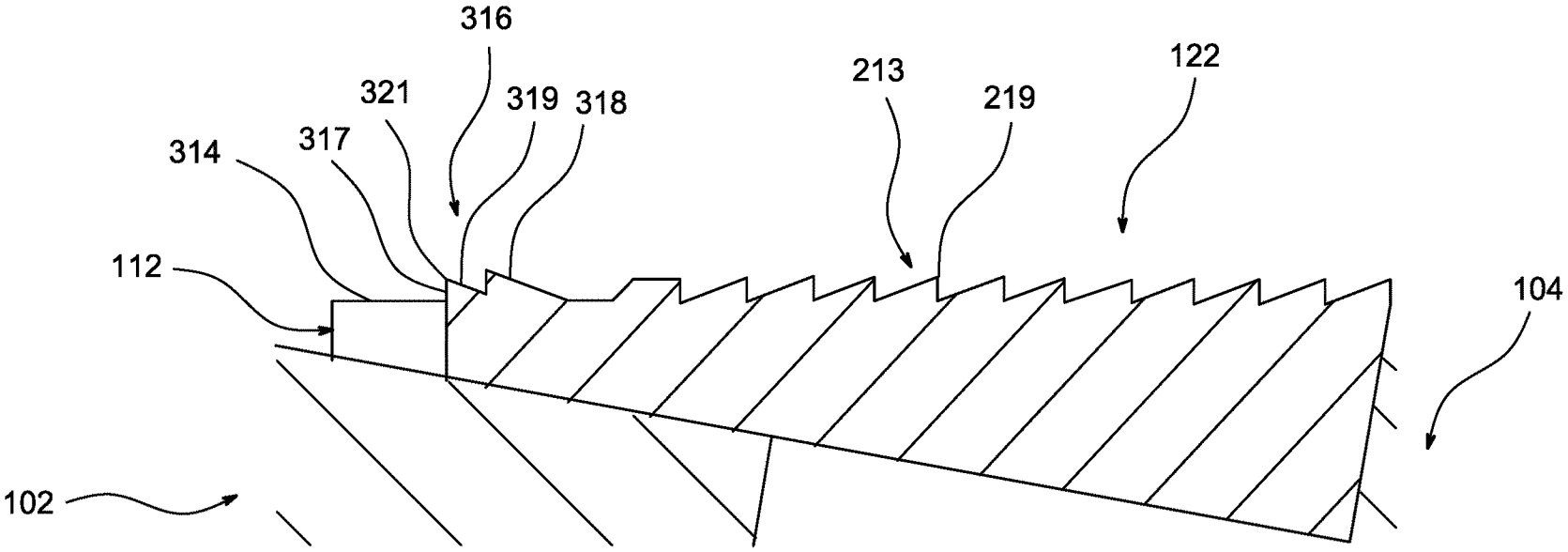
FIG. 3B illustrates an enlarged view of the portion of the frac plug indicated by the detail labeled 3B of FIG. 3A.

FIG. 3B illustrates an enlarged view of the portion of the frac plug 300 indicated by the detail labeled 3B of FIG. 3A. As shown in FIG. 3B, the back-up ring 112 of the frac plug 300 may be trapezoidal and have a relatively smooth outer surface 314. In the exemplary embodiment, the slip 106 includes a left-hand thread profile 122 where the crest 219 (only one indicated) of each thread 213 (only one indicated) is angled towards the second sub 104, as described above. Additionally, a portion of the slip 106 adjacent the back-up ring 112 may define one or more threads 316. Each thread 316 includes a first flank 317 that is shorter than a second flank 319, angling the crest 321 of each thread 316 towards the first sub 102. In one embodiment, the slip 106 may include a second thread 318 has a larger pitch, a larger pitch diameter, or both a larger pitch and a larger pitch diameter than the other threads 316 that have crests 321 angled towards the first sub 102.

Other embodiments of the slip 106 may include threads 316 that have a pitch, a pitch diameter, or both a pitch and a pitch diameter that are the same size, or a different thread may have a larger pitch, a larger pitch diameter, or both a larger pitch and a larger pitch diameter than the other threads 316. In another embodiment, the threads 316 may be replaced by teeth (not shown) having points (not shown) that angle towards the first sub 102. Further embodiments of the slip 106 may include a left-hand thread profile 122, threads 316, or both a left-hand thread profile 122 and threads 316 that have crests 219, 321 that are generally perpendicular to the outer surface 124 of the slip 106.

It should be appreciated that while the slip 106 is particularly well suited to the frac plug 100, the present disclosure is not thereby limited. The slip 106 may be used on other frac plugs having a single body, a central mandrel, or more than one slip. Similarly, the slip 106 disclosed herein includes features that may readily be applied to slips currently used on other downhole tools.

Figure 4:
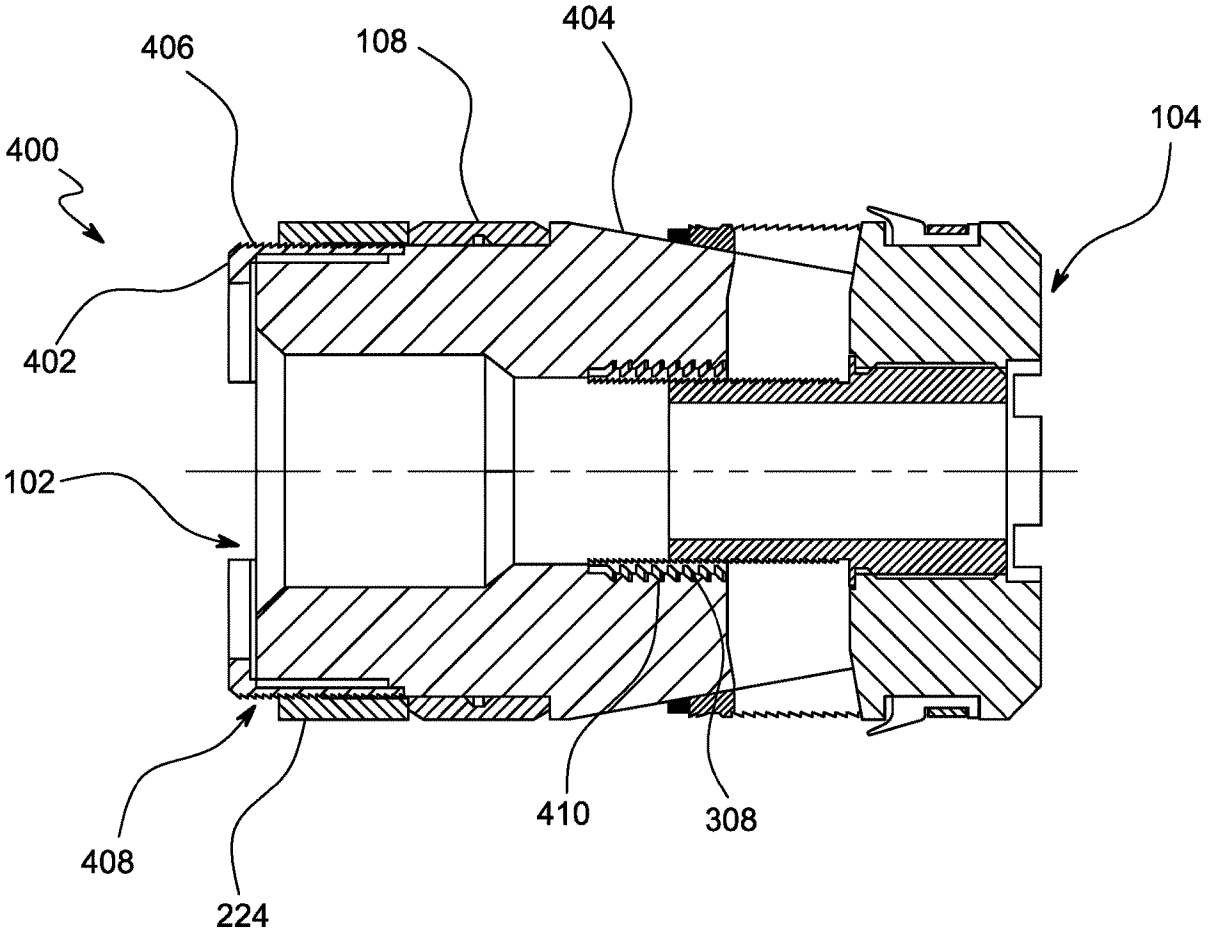
FIG. 4 illustrates a cross-sectional view of an exemplary frac plug, according to one or more embodiments disclosed.

FIG. 4 illustrates a cross-sectional view of an exemplary frac plug 400, according to one or more embodiments. Although the frac plug 400 in FIG. 4 is alternative to the frac plugs 100 and 300 in FIGS. 1, 2A, and 3A, it is substantially similar in several respects. Accordingly, like numerals indicate like elements and therefore will not be described again in detail except where material to the present embodiment.

The first sub 102 of the frac plug 400 may include a cast metallic cap 402 coupled to a resin and fiber composite main body 404, as shown in FIG. 4. The cap 402 may be coupled to the main body 404 using adhesives, a threaded connection, or both. Still other mechanisms for coupling the cap 402 and the main body 404, such as bonding and mechanical fasteners, may be used in alternative embodiments. Although the composite material in the exemplary embodiment of the main body 404 is a resin and fiber composite, other suitable composites known in the art may be used. Additionally, other embodiments of the cap 402 may be machined or formed from powdered metal.

As illustrated in this particular embodiment, the cap 402 may include threads 406 defined in an outer surface 408 of the cap 402. The threads 406 may engage with the compression ring 224 to retain the sealing element 108. Additionally, the lock ring 308 may engage with inner threads 410 defined by the main body 404 to couple the first sub 102 and the second sub 104, as shown in FIG. 4.

Figure 5:
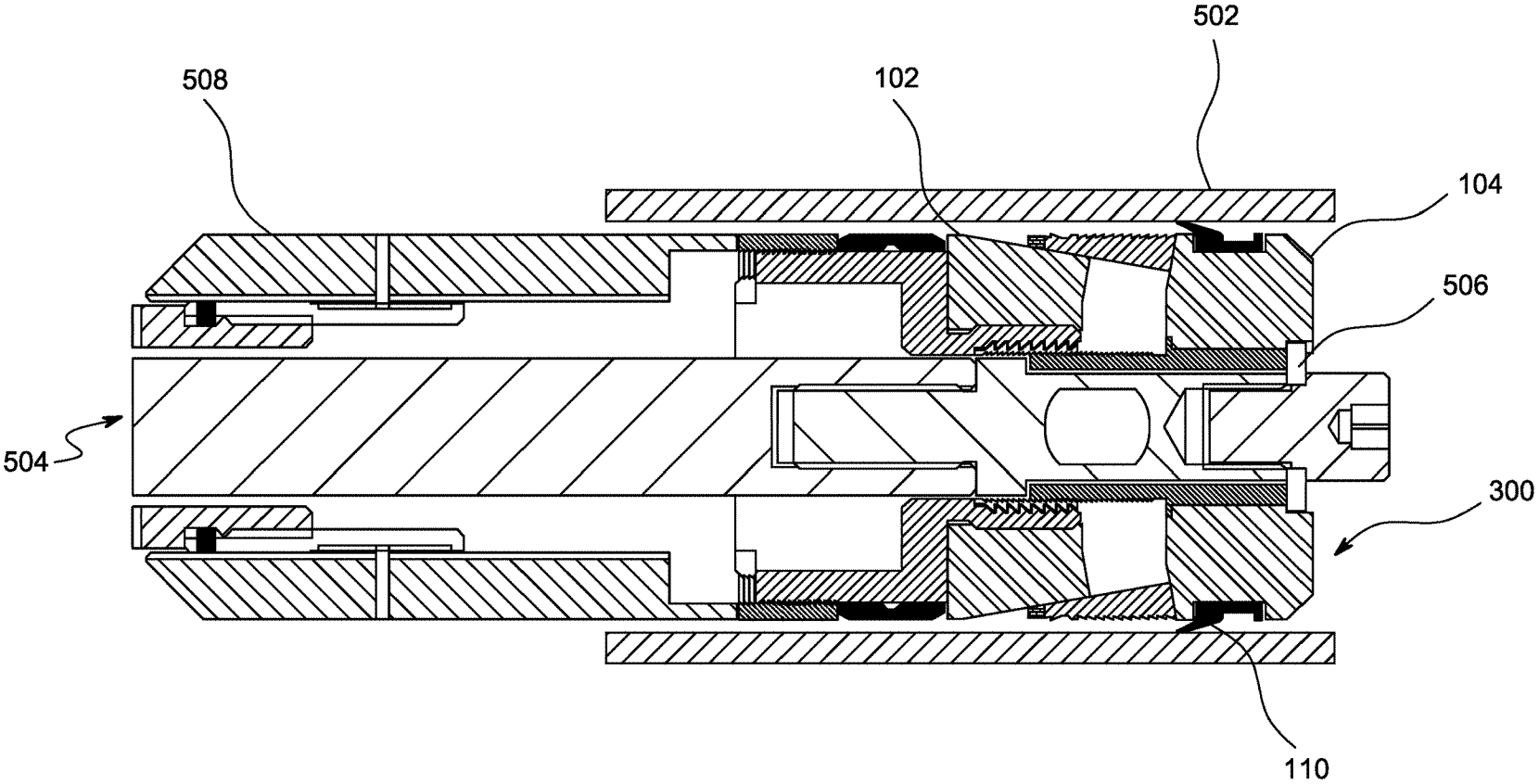
FIG. 5 illustrates the frac plug of FIG. 3A being run into the wellbore.

FIGS. 5-9 illustrate the installation of the frac plug 300 of FIG. 3A. Initially, the frac plug 300 is positioned within a tubular section 502 using a running tool 504 that extends through the frac plug 300, as shown in FIG. 5. The frac plug 300 is retained on the running tool 504 by a shear ring 506 configured to break at a predetermined load and a cylindrical retainer 508. The shear ring 506 may be positioned adjacent the second sub 104 and the cylindrical retainer 508 may be positioned adjacent the first sub 102. The process of positioning the frac plug 300 within the tubular section 502 may be aided by the pump down ring 110, which helps move the frac plug 300 into position within the tubular section 502. Once the frac plug 300 reaches the desired location, the running tool 504 begins to compress the frac plug 300 by pulling the shear ring 506 towards the cylindrical retainer 508 and pushing the cylindrical retainer 508 towards the shear ring 506.

Figure 6:
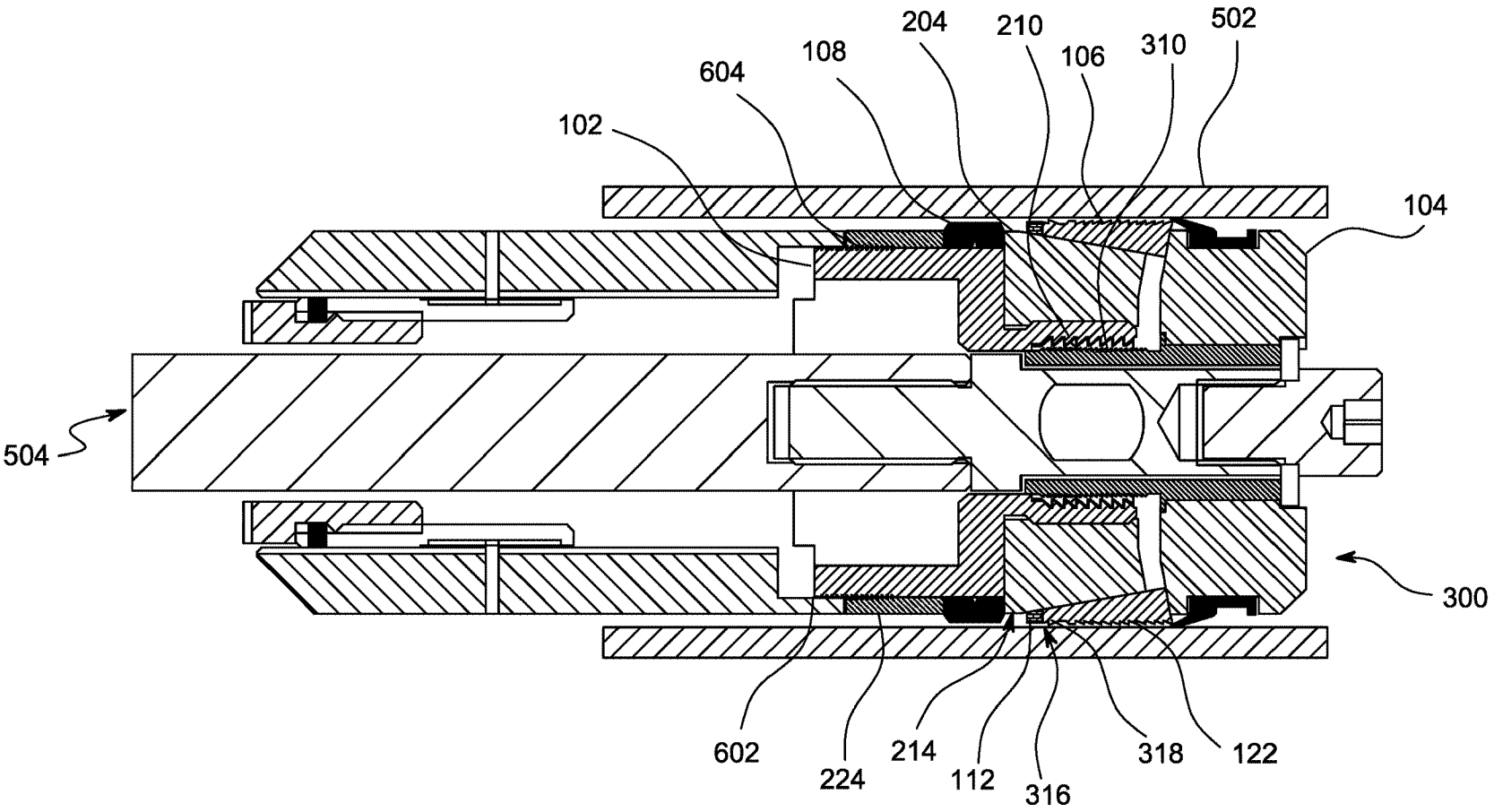
FIG. 6 illustrates the frac plug of FIG. 3A as the frac plug is being set in position within a tubular section by a running tool after being run in as shown in FIG. 5.

As shown in FIG. 6, the tapered surface 214 of the outer sleeve 204 may radially expand the slip 106 and back-up ring 112 as the frac plug 300 is compressed. In some embodiments, this expansion may cause the slip 106 to fracture along the longitudinal grooves 118, creating a plurality of slip segments (not shown). In other embodiments, the longitudinal grooves 118 in the slip 106 may allow the slip 106 to expand without fracturing. As the back-up ring 112 is made of a ductile material, the back-up ring 112 expands without fracturing as it moves along the tapered surface 214.

As the frac plug 300 is compressed, the threads 316 on the slip 106 that are facing the first sub 102 contact the tubular section 502. The threads 316, and, in particular, the larger thread 318, may engage or "bite" into the inner diameter of tubular section 502, preventing further movement of the second sub 104 towards the first sub 102. Since the frac plug 300 is being compressed by the running tool 504, the cylindrical retainer 508 will continue to push the first sub 102 towards the second sub 104. This movement allows the slip 106 and back-up ring 112 to continue to move along the tapered surface 214 of the outer sleeve 204. The continued expansion of the slip 106 allows the left-hand threads 122 of the slip 106 to engage with the tubular section 502, preventing movement of the slip 106 away from the first sub 102 and further retaining the frac plug 300 in position.

Additionally, the compression ring 224 shifts along the external threads 602 of the first core 202 as the frac plug is compressed, compressing the sealing element 108 and creating a seal between the frac plug 300 and the tubular section 502. The interface between the compression ring 224 and the first core 202 may also have a ratcheting effect, where the threads 604 of the compression ring 224 slide over the external threads 602 of the first core in one direction, but are restricted from moving in the opposite direction by the external threads 602. Accordingly, the ratcheting effect may prevent movement of the compression ring 224 away from the sealing element 108 and the outer sleeve 204. Similarly, the lock ring 308 may ratchet along the inner threads 210 of the first core 202, and the second core 206 may ratchet along the inner threads 310 the lock ring 308, preventing decompression of the frac plug 300.

As shown in FIG. 6, the compression ring 224 and sealing element 108 are both circumferentially disposed about the first sub 102 and separated from the slip 106 by the outer sleeve 204. This allows the compressive force applied by the running tool 504 to independently act on the ratcheting interface between the compression ring 224 and the first sub 102, and the ratcheting interface between the first sub 102, lock ring 308, and the second sub 104. This arrangement allows the frac plug 300 to continue to compress even if one of the interfaces reaches full compression before the other interface, ensuring the frac plug 300 is fully set within the tubular section.

Figure 7:
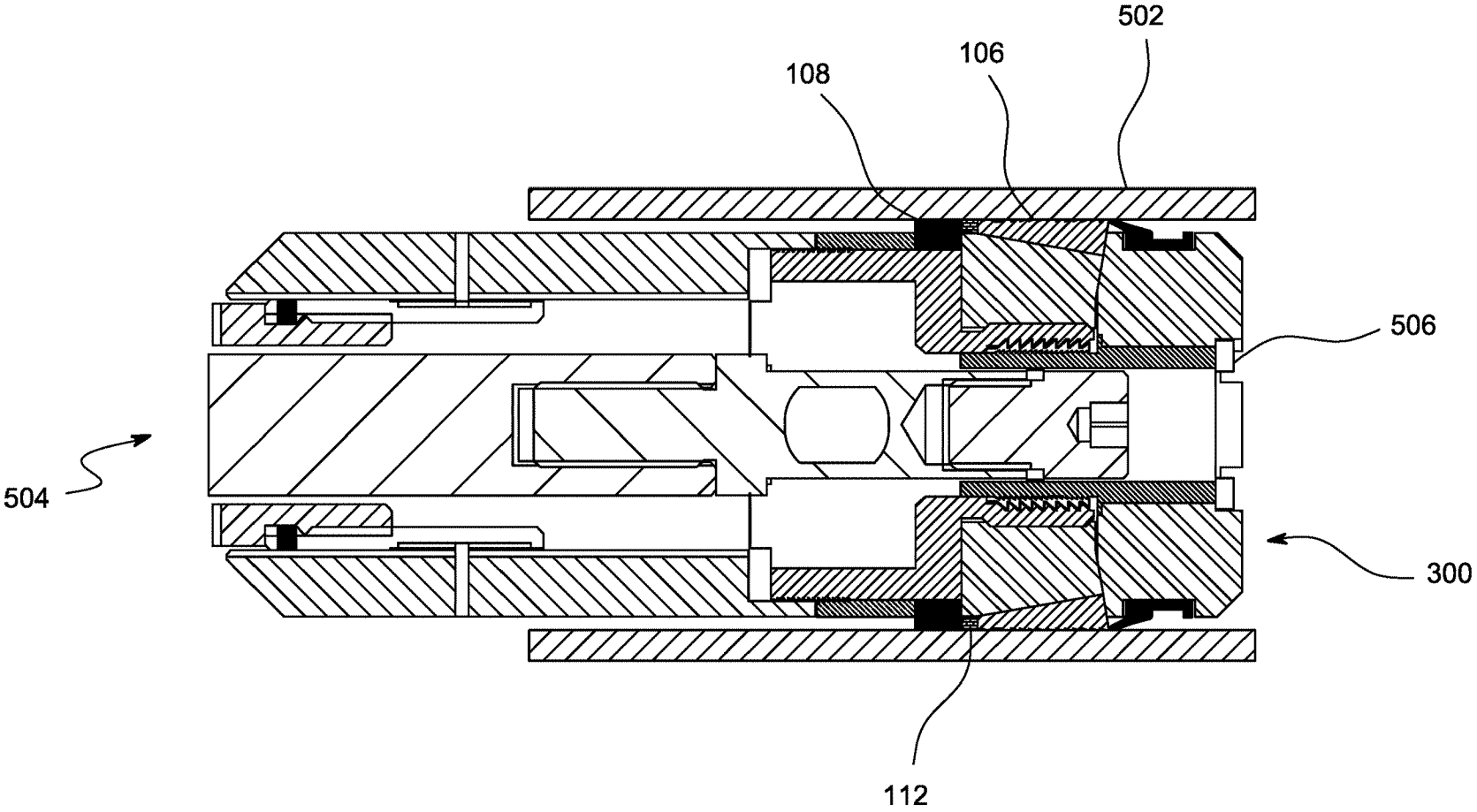
FIG. 7 illustrates the running tool being retracted from the frac plug of FIG. 3A after the frac plug is set as shown in FIG. 6.

As shown in FIG. 7, the slip 106 may engage with the inner diameter of the tubular section 502 when the frac plug 300 is set, securing the frac plug 300 in place. Additionally, the back-up ring 112, having expanded into the position shown in FIG. 7, contacts the tubular section 502 and may prevent extrusion of the sealing element 108. Once the frac plug 300 is set in position, the shear ring 506 breaks when the predetermined load is reached. The running tool 504 is then tripped out of the tubular section.

Figure 8:
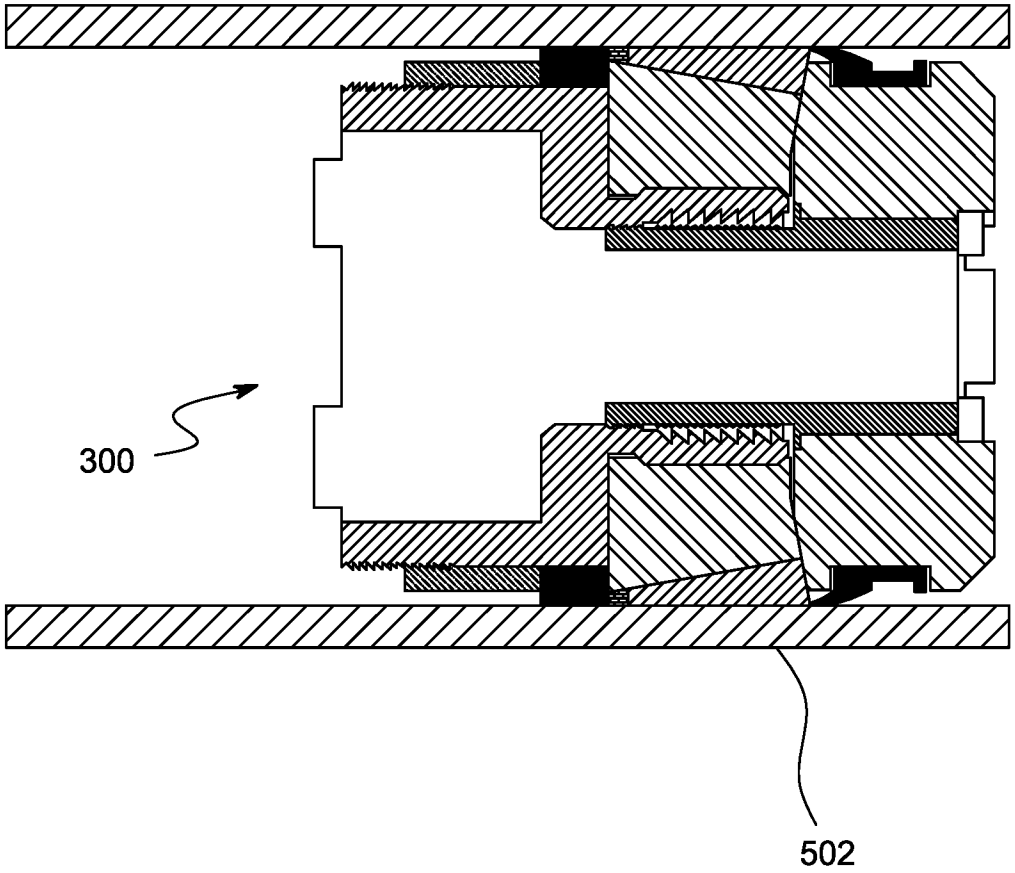
FIG. 8 illustrates the frac plug of FIG. 3A in the set position within a tubular section with the running tool fully retracted.
Figure 9:
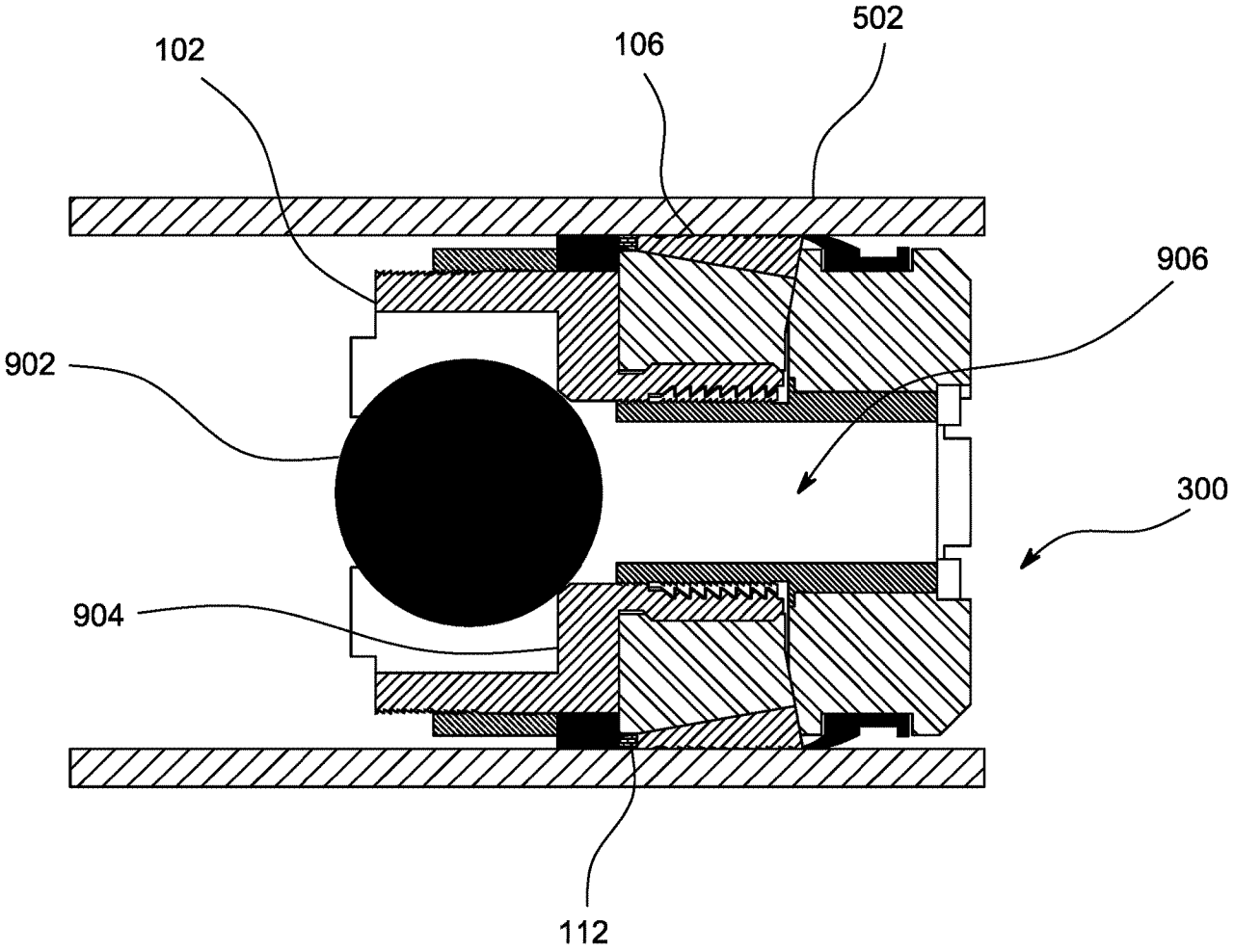
FIG. 9 illustrates the frac plug of FIG. 3A once set and sealed.

Once the running tool 504 is removed from the frac plug 300 and tubular section 502, as shown in FIG. 8, a sealing ball 902 is dropped down the tubular section 502. The sealing ball 902 seats against the inner surface 904 of the first sub 102, as shown in FIG. 9, sealing the bore 906 of the frac plug 300. The force of the sealing ball 902 against the first sub 102 of the frac plug 300 may further secure the frac plug 300 in place by shifting the back-up ring 112 and slip 106 further along the tapered surface 214 of the first sub 102.

Although not illustrated, it should be understood that the processes of running and setting frac plugs 100 and 400 are substantially similar to the process of running and setting frac plug 300. However, the second sub 104 of frac plug 100 ratchets within the first sub 102 to retain the frac plug 100 in the compressed position, omitting the lock ring 308.

Once the fracturing operations are complete, the frac plugs 100, 300, and 400 may be removed through milling. In embodiments employing a slip 106 with a left-hand thread 122, the left-hand thread 122 of the slip 106 may prevent the frac plug 300 from rotating as the frac plug 100, 300 is being milled, since milling tools typically rotate clockwise. Additionally, the castellations 116 in the first and second subs 102, 104 of the frac plug 100, 300 may allow the frac plug 300 to interface with a second, downstream frac plug 100, 300 as it is milled, reducing or eliminating rotational movement of the frac plug 100, 300 being milled.

In addition to the embodiments described above, U.S. Provisional Patent Application Ser. Nos. 62/350,231, 62/382,464, and 62/466,482 incorporated by reference above disclose additional embodiments differing from embodiments described herein in various ways. Although not expressly disclosed herein, these embodiments disclosed in the aforementioned provisional applications are, as previously stated, incorporated by reference into the present application. It is to be understood that the lack of an express disclosure herein does not disclaim such embodiments. Those incorporated embodiments are, through their incorporation, a part of this disclosure as if expressly set forth herein. They therefore are within the scope of the subject matter claimed below.

As previously noted, the embodiments disclosed in the above provisional applications differ from the embodiments disclosed herein. For example, the embodiment disclosed in Provisional Application 62/350,231 includes a sealing element 108 with an integrated steel back-up ring and pump down ring 110. The embodiment of Provisional Application 62/350,231 also includes a tapered second sub 104. The embodiment of Provisional Application 62/350,231 further includes a back-up ring 112 that is circumferentially disposed about the taper of the second sub and pushes the sealing element 108 up the tapered surface 214 of the first sub 102 to expand the sealing element 108, instead of compressing the sealing element with a compression ring 224.

Additional embodiments, disclosed in Provisional Application 62/382,464, include many of the features disclosed in Provisional Application 62/350,231. However, one embodiment disclosed in Provisional Application 62/382,464 includes a back-up ring 112 that is integral with the slip 106, instead of the sealing element 108. Another embodiment disclosed in Provisional Application 62/382,464 includes a slip 106 having a right-hand thread profile defined in the outer surface 124 instead of a left-hand thread profile 122 to accommodate milling tools that rotate counter-clockwise.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A frac plug, comprising:

a first sub having a taper extending along a first portion of an outer surface thereof;

a second sub that is threadably engaged with the first sub;

a slip circumferentially disposed about the taper of the outer surface of the first sub and adjacent to the second sub;

a back-up ring having at least one thread, wherein the back-up ring is circumferentially disposed about the taper of the outer surface of the first sub;

a sealing element circumferentially disposed about the first sub; and a compression ring circumferentially disposed about the first sub and abutting the sealing element, the compression ring having an inner surface that is threadably engaged with a second portion of the outer surface of the first sub.

2. The frac plug of claim 1, wherein the second sub is threadably engaged with the first sub via a lock ring having a first outer surface that is threadably engaged with a first inner surface of the first sub and a second inner surface of the lock ring that is threadably engaged with a second outer surface of the second sub.

3. The frac plug of claim 2, wherein the lock ring is a c-ring.

4. The frac plug of claim 2, wherein threads defined by the first outer surface of the lock ring have a larger pitch than threads defined by the second inner surface of the lock ring.

5. The frac plug of claim 2, wherein threads defined by the first outer surface of the lock ring have a pitch that is the same size as a pitch of the threads defined by the second inner surface of the lock ring.

6. The frac plug of claim 2, wherein threads defined by the first outer surface of the lock ring have a smaller pitch than a pitch of the threads defined by the second inner surface of the lock ring.

7. The frac plug of claim 1, wherein the first sub comprises:

a main body; and a cap coupled to the main body.

8. The frac plug of claim 7, wherein the second sub is threadably engaged with the main body of the first sub.

9. The frac plug of claim 8, wherein the second sub is threadably engaged with the main body of the first sub via a lock ring having a first outer surface that is threadably engaged with a first inner surface of the main body and a second inner surface of the lock ring that is threadably engaged with a second outer surface of the second sub.

10. The frac plug of claim 7, wherein the compression ring is threadably engaged with the cap of the first sub.

11. The frac plug of claim 1, wherein at least one of the first sub and the second sub is entirely fabricated from a metal.

12. The frac plug of claim 1, wherein at least one of the first sub and the second sub are at least partially fabricated from a composite material.

13. The frac plug of claim 12, wherein at least one of the first sub and the second sub are comprised entirely of a composite material.

14. The frac plug of claim 1, wherein at least one of the first sub and the second sub comprises a composite material outer sleeve and a metal inner core engaged with and structurally supporting the outer sleeve.

15. The frac plug of claim 1, wherein the back-up ring is fabricated from a ductile metal.

16. The frac plug of claim 1, wherein the back-up ring comprises brass.

17. A method for setting a frac plug within a tubular section, the method comprising:

disposing the frac plug on a running tool;

positioning the frac plug within the tubular section using the running tool; and compressing the frac plug with the running tool such that a second sub of the frac plug ratchets along a threadable engagement with a first sub to hold the frac plug in a compressed position and causing a slip to expand along a tapered portion of an outer surface of the first sub and engage with the tubular section, retaining the frac plug in position within the tubular section, wherein the frac plug further comprises a compression ring and a sealing element, and compressing the frac plug with the running tool further includes ratcheting the compression ring along a threadable engagement with the first sub of the frac plug, compressing the sealing element to seal an annular gap between the frac plug and the tubular section, and holding the sealing element in the compressed position, and wherein the frac plug further comprises a back-up ring having at least one thread and wherein the back-up ring is circumferentially disposed about the tapered portion of the outer surface of the first sub a slip, and compressing the frac plug with the running tool further comprises causing the back-up ring to expand along the tapered portion of the outer surface of the first sub and engage with the tubular section, and prevent extrusion of the sealing element.

18. The method of claim 17, wherein the threadable engagement between the second sub and the first sub comprises a lock ring having a first outer surface that is threadably engaged with a first inner surface of the first sub and a second inner surface the lock ring that is threadably engaged with a second outer surface of the second sub.

* * * * *